US010332475B2

(12) United States Patent
Huang

(10) Patent No.: US 10,332,475 B2
(45) Date of Patent: Jun. 25, 2019

(54) GATE VOLTAGE DRIVING DEVICE, METHOD, DRIVING CIRCUIT, AND LIQUID CRYSTAL DISPLAY PANEL

(71) Applicant: Shenzhen China Star Optoelectronics Technology Co., Ltd., Shenzhen, Guangdong (CN)

(72) Inventor: Xiaoyu Huang, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/500,222

(22) PCT Filed: Jan. 20, 2017

(86) PCT No.: PCT/CN2017/071896

§ 371 (c)(1),
(2) Date: Jan. 2, 2018

(87) PCT Pub. No.: WO2018/040497

PCT Pub. Date: Mar. 8, 2018

(65) Prior Publication Data

US 2018/0218707 A1 Aug. 2, 2018

(30) Foreign Application Priority Data

Aug. 31, 2016 (CN) ..... 2016 1 0794373

(51) Int. Cl.
*G09G 3/36* (2006.01)

(52) U.S. Cl.
CPC ..... *G09G 3/3696* (2013.01); *G09G 3/3648* (2013.01); *G09G 3/3674* (2013.01); *G09G 2310/0264* (2013.01); *G09G 2330/021* (2013.01)

(58) Field of Classification Search
CPC ..... G09G 3/3696
USPC ..... 345/212
See application file for complete search history.

(56) References Cited

U.S. PATENT DOCUMENTS 5,867,057 A 2/1999 Hsu et al.

FOREIGN PATENT DOCUMENTS

| | | | |
|---|---|---|---|
| CN | 101719352 | A | 6/2010 |
| CN | 102136247 | A | 7/2011 |
| CN | 102376275 | A | 3/2012 |
| CN | 102411911 | A | 4/2012 |
| CN | 103220845 | A | 7/2013 |
| CN | 103258515 | A | 8/2013 |
| CN | 105096857 | A | 11/2015 |

(Continued)

OTHER PUBLICATIONS

International Search Report dated Jun. 2, 2017 for International Patent Application No. PCT/CN2017/071896.

(Continued)

*Primary Examiner* — Abdul-Samad A Adediran

(57) ABSTRACT

Disclosed is a gate voltage driving device of a liquid crystal display device. The gate voltage driving device includes a voltage input module, a control module, and a voltage output module. Further disclosed are a gate voltage driving method, a driving circuit, and a liquid crystal display panel. A scanning signal is enabled to have different chamfers by improving a structure of a gate driving circuit, and only two control terminals are needed. Control logic is simple, and improvement costs are relatively low.

17 Claims, 3 Drawing Sheets

(56) References Cited

FOREIGN PATENT DOCUMENTS

| | | | |
|---|---|---|---|
| CN | 106128398 | A | 11/2016 |
| JP | 2006296007 | A | 10/2006 |
| KR | 20020083515 | A | 11/2002 |

OTHER PUBLICATIONS

Chinese Office Action dated Mar. 2, 2018 for Chinese Patent Application No. 201610794373.X.

GATE VOLTAGE DRIVING DEVICE, METHOD, DRIVING CIRCUIT, AND LIQUID CRYSTAL DISPLAY PANEL

CROSS-REFERENCE TO RELATED APPLICATIONS

This application claims the priority of Chinese patent application CN 201610794373.X, entitled "Gate voltage driving device, method, driving circuit, and liquid crystal display panel" and filed on Aug. 31, 2016, the entirety of which is incorporated herein by reference.

FIELD OF THE INVENTION

The present disclosure relates to the technical field of display, and in particular, to a gate voltage driving device, a gate voltage driving method, a driving circuit, and a liquid crystal display panel.

BACKGROUND OF THE INVENTION

Chinese patent application CN 105070243A has disclosed a gate turn-on voltage compensation circuit, a display panel, a driving method, and a display device. The patent application relates to a gate voltage driving method. In the gate voltage driving method, a clock control module is used for controlling a chamfering module to output corresponding chamfered voltage signals in corresponding time periods, so as to obtain different chamfering depths. Control logic of the method is complicated, and the driving circuit is not improved sufficiently.

SUMMARY OF THE INVENTION

The object of the present disclosure is to solve the problem of complicated control logic of a gate voltage driving device and insufficient improvement to a driving circuit in the prior art.

According to a first aspect, the present disclosure provides a gate voltage driving device of a liquid crystal display device. The gate voltage driving device comprises a voltage input module, a control module, and a voltage output module. The control module comprises a first control unit and a second control unit. The first control unit has a first voltage division part and a first switching part connected in series with each other. The second control unit has a second voltage division part. The first control unit and the second control unit are connected in parallel with each other. The voltage input module is configured to receive a driving voltage. The first switching part is configured to receive a switching quantity signal which is used for controlling a turn-on or a turn-off of the first switching part. When the first switching part is turned on, a turn-on voltage is output from the voltage output module to a gate.

Preferably, the second voltage division part is a voltage division resistor, and the first switching part is an N-MOS transistor.

Preferably, the switching quantity signal is a high-level signal or a low-level signal.

Preferably, the control module further comprises a third control unit connected in parallel with the first control unit, and the third control unit comprises a third switching part and a third voltage division part. When the switching quantity signal of the first switching part and a switching quantity signal of the third switching part both are at a high level, the voltage output module outputs a first voltage. When one of the switching quantity signal of the first switching part and the switching quantity signal of the third switching part is at a low level and the other is at the high level, the voltage output module outputs a second voltage. When the switching quantity signal of the first switching part and the switching quantity signal of the third switching part both are at the low level, the voltage output module outputs a third voltage. The first voltage is larger than the second voltage, and the second voltage is larger than the third voltage.

According to a second aspect, the present disclosure provides a driving method based on the first aspect of the present disclosure. The method comprises steps of: determining a turn-on voltage to be output according to a requirement for a turn-on voltage at a control terminal; determining a switching quantity signal according to the turn-on voltage to be output at the control terminal; outputting the switching quantity signal at the control terminal; receiving the switching quantity signal at a driving terminal, and outputting the turn-on voltage to a gate according to the switching quantity signal at the driving terminal.

Preferably, the step of outputting the turn-on voltage to the gate of according to the switching quantity signal may further comprise a step of dividing a voltage for adjusting a value of the turn-on voltage.

Preferably, the switching quantity signal is a high-level signal or a low-level signal.

Preferably, the control module further comprises a third control unit connected in parallel with the first control unit, and the third control unit comprises a third switching part and a third voltage division part. When a switching quantity signal of the first switching part and a switching quantity signal of the third switching part both are at a high level, a first turn-on voltage is output. When one of the switching quantity signal of the first switching part and the switching quantity signal of the third switching part is at a low level and the other is at the high level, a second turn-on voltage is output. When the switching quantity signal of the first switching part and the switching quantity signal of the third switching part both are at the low level, a third turn-on voltage is output. The first turn-on voltage is larger than the second turn-on voltage, and the second turn-on voltage is larger than the third turn-on voltage.

According to a third aspect, the present disclosure provides a gate voltage driving circuit of a liquid crystal display device. The gate voltage driving circuit comprises a first resistor, a second resistor, a third resistor, a fourth resistor, a fifth resistor, a first field effect transistor, a second field effect transistor, a voltage input terminal, and a voltage output terminal. The first resistor and the first field effect transistor are connected in series with each other as a first subcircuit. The second resistor and the second field effect transistor are connected in series with each other as a second subcircuit. The third resistor, the fourth resistor, and the fifth resistor are connected in parallel with one another as a third subcircuit. The first subcircuit, the second subcircuit, and the third subcircuit are connected in parallel with one another, and then are connected between the voltage input terminal and the voltage output terminal. A gate of the first field effect transistor and a gate of the second field effect transistor are configured to receive a first switching quantity signal and a second switching quantity signal, respectively. The first switching quantity signal is configured to control a turn-on and a turn-off of the first field effect transistor, and when the first field effect transistor is turned on, a turn-on voltage is output from the voltage output module to a gate. The second switching quantity signal is configured to control a turn-on and a turn-off of the second field effect transistor, and when the second field effect transistor is turned on, a turn-on voltage is output from the voltage output module to the gate.

According to a fourth aspect, the present disclosure provides a liquid crystal display panel which comprises a gate driving device and a printed circuit board connected to the gate driving device. The printed circuit board comprises a gate voltage driving circuit as described in the third aspect of the present disclosure.

The present disclosure has following technical effects. A scanning signal is enabled to have different chamfers by improving a structure of a gate driving circuit, and only two control terminals are needed. Control logic is simple, and improvement costs are relatively low.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The drawings necessary for explaining the embodiments are introduced briefly below to illustrate the technical solutions of the embodiments of the present disclosure more clearly. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no conflict, all the technical features mentioned in all the embodiments can be combined together in any manner, and the technical solutions obtained in this manner all fall within the scope of the present disclosure.

A chamfering circuit of the present disclosure is configured to adjust chamfering resistance thereof according to a control signal to reduce a received DC voltage to different chamfering voltages, so that scanning signals have different chamfers. Hence, a uniformity ratio of each area of a liquid crystal display panel can be kept the same.

Embodiment 1

Figure 1:
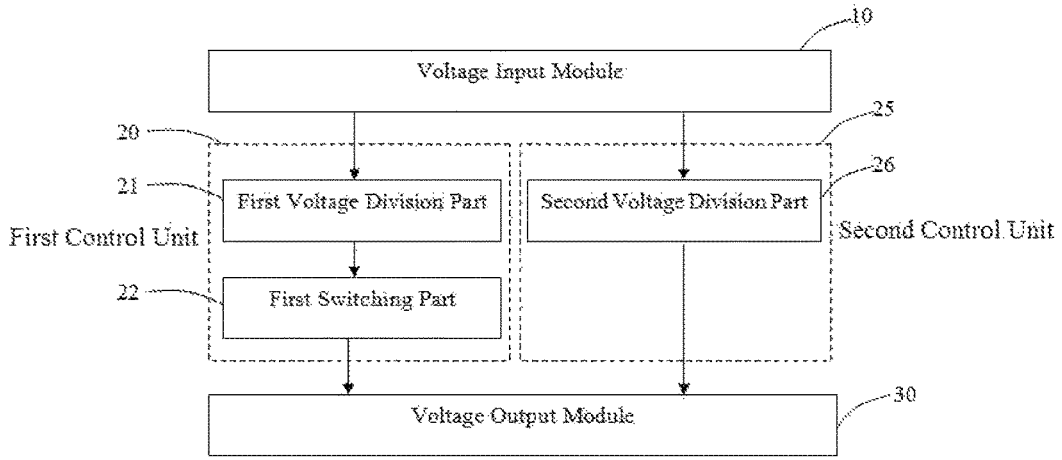
FIG. 1 schematically shows a structure of a gate voltage driving device according to an embodiment of the present disclosure.

FIG. 1 schematically shows a structure of a gate voltage driving device of a liquid crystal display device according to the present embodiment. The gate voltage driving device comprises a voltage input module 10, a control module, and a voltage output module 30. The control module comprises a first control unit 20 and a second control unit 25. The first control unit 20 has a first voltage division part 21 and a first switching part 22 connected in series with each other. The second control unit 25 has a second voltage division part 26. The first control unit 20 and the second control unit 25 are connected in parallel with each other. The voltage input module 10 is configured to receive a driving voltage. The first switching part 22 is configured to receive a switching quantity signal. The switching quantity signal is configured to control a turn-on or a turn-off of the first switching part 22. When the first switching part 22 is turned on, a turn-on voltage is output from the voltage output module 30 to a gate. The gate herein refers to a gate of a switching element (e.g., a thin film transistor) of a liquid crystal display device.

Specifically, the second voltage division part 26 can be a voltage division resistor, and the first switching part 22 can be an N-MOS transistor. The second voltage division part 26 also can be a slide rheostat, a potentiometer, or a variable resistance box. The first switching part 22 also can be an optically-coupled switch. The voltage input module 10 and the voltage output module 30 can be interface circuits, or wires used for transmitting electric signals. The switching quantity signal can be a high-level signal or a low-level signal. Generally, a logic voltage 3.3 V is a high level, and a logic voltage 0 V is a low level. More voltage signals can be arranged according to the logic voltages, and limitations are not made to the switching quantity signal in the present disclosure.

The gate voltage driving device of a liquid crystal display device can further comprise a third control unit which comprises a third voltage division part and a third switching part. When a switching quantity signal of the first switching part and a switching quantity signal of the third switching part (i.e., the switching quantity signal used for controlling the first switching part, and the switching quantity signal used for controlling the third switching part) both are at a high level, the voltage output module outputs a first voltage. When one of the switching quantity signal of the first switching part and the switching quantity signal of the third switching part is at a low level and the other is at the high level, the voltage output module outputs a second voltage. When the switching quantity signal of the first switching part and the switching quantity signal of the third switching part both are at the low level, the voltage output module outputs a third voltage. The first voltage is larger than the second voltage, and the second voltage is larger than the third voltage.

Specifically, a switching part (the first switching part or the third switching part) can be turned off when it receives a low-level signal, and can be turned on when it receives a high-level signal. Based on an On state and an Off state of a circuit, signals input or output by a device of the circuit would also change. For example, when a voltage division part, i.e., a resistor, is connected in series with a switching part, if the switching part receives a low-level signal, it would be turned off, i.e., a circuit would be disconnected. Since control units are connected in parallel with one another, disconnection of a subcircuit would result in an increase of overall resistance, thereby reducing an output voltage.

Embodiment 2

Figure 2:
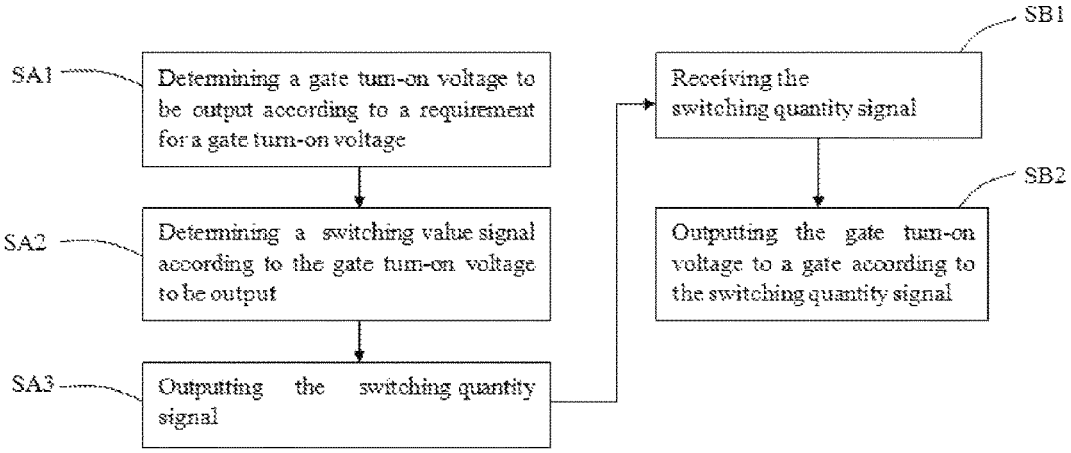
FIG. 2 is a flowing chart showing a gate voltage driving method according to an embodiment of the present disclosure.

The present disclosure further comprises a driving method based on Embodiment 1. As shown in FIG. 2, the method comprises steps as follows.

In step SA1, at a control terminal, a turn-on voltage to be output is determined according to a requirement for a turn-on voltage.

In step SA2, at the control terminal, a switching quantity signal is determined according to the turn-on voltage to be output.

In step SA3, at the control terminal, the switching quantity signal is output.

In step SB1, at a driving terminal, the switching quantity signal is received.

In step SB2, at the driving terminal, the turn-on voltage is output to a gate according to the switching quantity signal.

The step of outputting the turn-on voltage to the gate according to the switching quantity (i.e., step SB2) can further comprise a step of dividing a voltage for adjusting a value of the turn-on voltage. The switching quantity signal is a high level signal or a low level signal.

In an embodiment, the number of switching quantity signals is 2, and the number of turn-on voltages to be output and the number of turn-on voltages both are 3. Specifically, when a switching quantity signal input to a first switching part and a switching quantity signal input to a third switching part both are at a high level, a first turn-on voltage is output. When one of the two switching quantity signals is at the high level and the other is at a low level, a second turn-on voltage is output. When the two switching quantity signals both are at the low level, a third turn-on voltage is output. Herein, the first turn-on voltage is larger than the second turn-on voltage, and the second voltage is larger than the third turn-on voltage. A gate driving device of the present embodiment is the same as that of Embodiment 1, and will not be described in detail herein.

Specifically, the control terminal can be provided at a system terminal of a liquid crystal display device, and the driving terminal can be provided at a printed circuit board of the liquid crystal display device.

In a specific embodiment, an operator selects a desired turn-on voltage, i.e., the turn-on voltage to be output according to needs. The desired turn-on voltage may have various optional voltage values. It should be noted that it is not necessary to manually select the desired turn-on voltage, and that it is also impossible to automatically select the gate desired turn-on voltage according to a voltage state in a detection circuit. Then, a switching quantity signal is determined according to the turn-on voltage to be output. For example, in the present embodiment, there are two switching parts (i.e., the first switching part and the third switching part). A voltage output by a circuit when the two switching parts are turned off (i.e., when the two switching parts both receive a low-level signal) is required. Therefore, at this time, two switching quantity signals both are determined as a low level. Next, the two switching quantity signals are output from the control terminal to the driving terminal. More specifically, a switching quantity signal is output from the system terminal to the printed circuit board, and the driving circuit receives the switching quantity signal. Finally, a turn-on voltage is output to a gate according to a driving signal.

Embodiment 3

Figure 3:
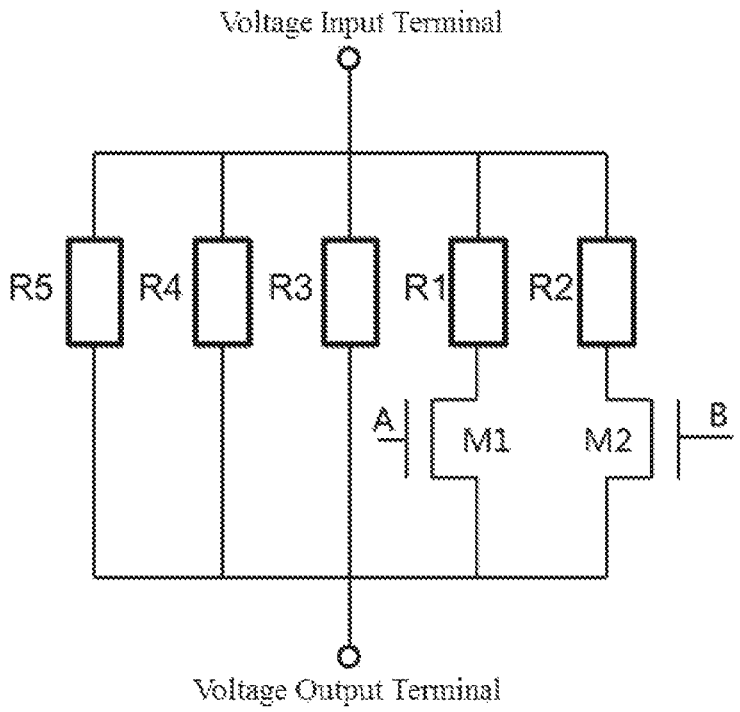
FIG. 3 schematically shows a structure of a gate voltage driving circuit according to an embodiment of the present disclosure.

The present disclosure further provides a gate voltage driving circuit of a liquid crystal display device. As shown in FIG. 3, the gate voltage driving circuit comprises a first resistor R1, a second resistor R2, a third resistor R3, a fourth resistor R4, a fifth resistor R5, a first field effect transistor M1, a second field effect transistor M2, a voltage input terminal, and a voltage output terminal. The first resistor R1 and the first field effect transistor M1 are connected in series with each other as a first subcircuit. The second resistor R2 and the second field effect transistor M2 are connected in series with each other as a second subcircuit. The third resistor R3, the fourth resistor R4, and the fifth resistor R5 are connected in parallel with one another as a third subcircuit. The first subcircuit, the second subcircuit, and the third subcircuit are connected in parallel with one another, and then are connected between the voltage input terminal and the voltage output terminal. A gate of the first field effect transistor M1 and a gate of the second field effect transistor M2 are configured to receive a first switching quantity signal and a second switching quantity signal, respectively. The first switching quantity signal is configured to control a turn-on and a turn-off of the first field effect transistor M1, and when the first field effect transistor M1 is turned on, a turn-on voltage is output from the voltage output module to the gate of the first field effect transistor. The second switching quantity signal is configured to control a turn-on and a turn-off of the second field effect transistor, and when the second field effect transistor is turned on, the turn-on voltage is output from the voltage output module to the gate of the second field effect transistor.

Specifically, in the present disclosure, a turn-on or a turn-off of the first field effect transistor M1 and the second field effect transistor M2 is adjusted by controlling levels of a first switching quantity signal A and a second switching quantity signal B, thereby changing an overall resistance of a circuit. Thus, a uniformity ratio of each area of a liquid crystal display panel can be kept the same.

In the present embodiment, voltage division resistors of the gate voltage driving circuit of the liquid crystal device (i.e., the third resistor R3, the fourth resistor R4, and the fifth resistor R5) have a same resistance which is set to P; a resistance of the first resistor R1 is set to M; and a resistance of the second resistor R2 is set to N.

When the first switching quantity signal A is at a low level and the second switching quantity signal B is at a low level, the first field effect transistor M1 and the second field effect transistor M2 both are in an Off state, and the first subcircuit where the first field effect transistor M1 is arranged and the second subcircuit where the second field effect transistor M2 is arranged both are in an Off state. An overall resistance of a chamfering circuit is P/3.

When the first switching quantity signal A is at a high level and the second switching quantity signal B is at a low level, the first field effect transistor M1 is in an On state, and the first subcircuit where the first field effect transistor M1 is arranged is turned on. Meanwhile, the second field effect transistor M2 is in an Off state, and the second subcircuit where the second field effect transistor M2 is arranged is turned on. The overall resistance of the chamfering circuit is $(P\times M)/(P\times 3M)$.

When the first switching quantity signal A is at a low level and the second switching quantity signal B is at a high level, the first field effect transistor M1 is in an Off state, and the first subcircuit where the first field effect transistor M1 is arranged is turned off. Meanwhile, the second field effect transistor M2 is in an On state, and the second subcircuit where the second field effect transistor M2 is arranged is turned on. The overall resistance of the chamfering circuit is $(P\times N)/(P\times 3N)$.

When the first switching quantity signal A is at a high level and the second switching quantity signal B is at a high level, the first field effect transistor M1 and the second field effect transistor M2 both are in an On state, and the first subcircuit where the first field effect transistor M1 is arranged and the second subcircuit where the second field effect transistor M2 is arranged both are in an On state. The overall resistance of the chamfering circuit is (P×M×N)/(3MP+3NP+9MN).

In the above described process, four different resistances in a same hardware are achieved by means of the chamfering circuit merely through control of levels of the first switching quantity signal A and the second switching quantity signal B.

It should be understood that the present embodiment is merely exemplary and that resistances of the resistors in the figure can be varied to form other variations based on specific conditions. In the present embodiment, the third resistor R3, the fourth resistor R4, and the fourth resistor R5 are configured to have a same resistance in order to facilitate calculation, and if resistances thereof are different, four different overall resistances of the chamfering circuit can also be obtained according to levels of the first switching quantity signal A and the second switching quantity signal B.

Embodiment 4

The present disclosure further provides a liquid crystal panel. As show in FIG. 4, the liquid crystal panel comprises a gate driving device 44 and a printed circuit board 43 connected with the gate driving device 44. The printed circuit board 43 comprises a gate voltage driving circuit as described in Embodiment 3.

Figure 4:
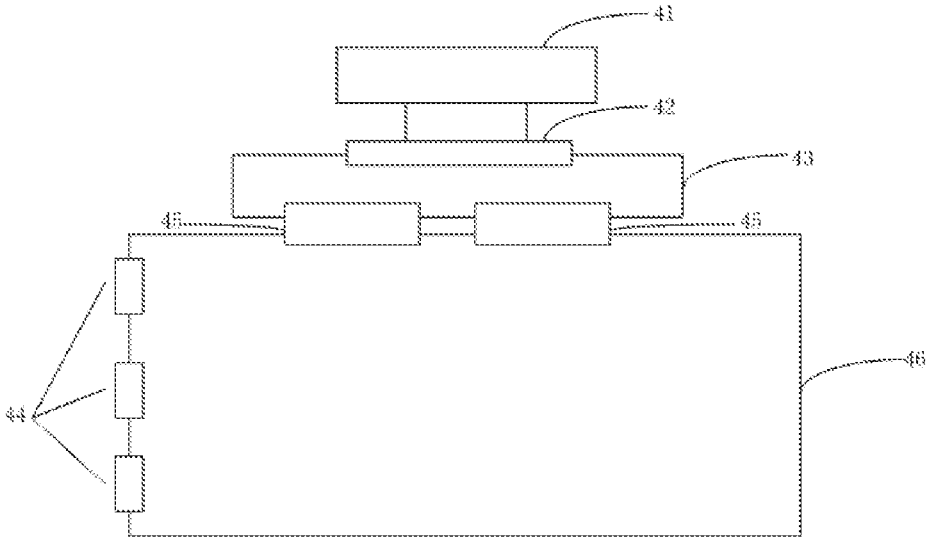
FIG. 4 schematically shows a structure of a liquid crystal display panel according to an embodiment of the present disclosure.

In FIG. 4, a liquid crystal panel 46, a system terminal 41 of a display device, a PCB connector 42, and a source driving device 45 are further included.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A gate voltage driving device of a liquid crystal display device, wherein the gate voltage driving device comprises a voltage input module, a control module, and a voltage output module, wherein:

the control module comprises a first control unit and a second control unit;

the first control unit has a first voltage division part and a first switching part connected in series with each other;

the second control unit has a second voltage division part;

the first control unit and the second control unit are connected in parallel with each other;

the voltage input module is configured to receive a driving voltage; and the first switching part is configured to receive a switching quantity signal, wherein the switching quantity signal received by the first switching part is configured to control a turn-on or a turn-off of the first switching part, and when the first switching part is turned on, a turn-on voltage is output from the voltage output module to a gate.

2. The device according to claim 1, wherein the second voltage division part is a voltage division resistor, and the first switching part is an N-MOS transistor.

3. The device according to claim 1, wherein the switching quantity signal received by the first switching part is a high-level signal or a low-level signal.

4. The device according to claim 2, wherein the switching quantity signal received by the first switching part is a high-level signal or a low-level signal.

5. The device according to claim 1, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, the voltage output module outputs a first voltage;

when one of the switching quantity signal received by the first switching part and the switching quantity signal received by the third switching part is at a low level and other one of the switching quantity signal received by the first switching part and the switching quantity signal received by the third switching part is at the high level, the voltage output module outputs a second voltage; and when the switching quantity signal received by the first switching part and the switching quantity signal received by the third switching part both are at the low level, the voltage output module outputs a third voltage, wherein the first voltage is larger than the second voltage, and the second voltage is larger than the third voltage.

6. The device according to claim 2, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, the voltage output module outputs a first voltage;

when one of the switching quantity signal received by the first switching part and the switching quantity signal received by the third switching part is at a low level and other one of the switching quantity signal received by the first switching part and the switching quantity signal received by the third switching part is at the high level, the voltage output module outputs a second voltage; and when the switching quantity signal received by the first switching part and the switching quantity signal received by the third switching part both are at the low level, the voltage output module outputs a third voltage, wherein the first voltage is larger than the second voltage, and the second voltage is larger than the third voltage.

7. The device according to claim 3, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, the voltage output module outputs a first voltage;

when one of the switching quantity signal received by the first switching part and the switching quantity signal received by the third switching part is at a low level and other one of the switching quantity signal received by the first switching part and the switching quantity signal received by the third switching part is at the high level, the voltage output module outputs a second voltage; and when the switching quantity signal received by the first switching part and the switching quantity signal received by the third switching part both are at the low level, the voltage output module outputs a third voltage, wherein the first voltage is larger than the second voltage, and the second voltage is larger than the third voltage.

8. The device according to claim 4, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, the voltage output module outputs a first voltage;

when one of the switching quantity signal received by the first switching part and the switching quantity signal received by the third switching part is at a low level and other one of the switching quantity signal received by the first switching part and the switching quantity signal received by the third switching part is at the high level, the voltage output module outputs a second voltage; and when the switching quantity signal received by the first switching part and the switching quantity signal received by the third switching part both are at the low level, the voltage output module outputs a third voltage, wherein the first voltage is larger than the second voltage, and the second voltage is larger than the third voltage.

9. A method for driving a gate voltage driving device of a liquid crystal display device, wherein the gate voltage driving device of the liquid crystal display device comprises a voltage input module, a control module, and a voltage output module, wherein:

the control module comprises a first control unit and a second control unit;

the first control unit has a first voltage division part and a first switching part connected in series with each other;

the second control unit has a second voltage division part;

the first control unit and the second control unit are connected in parallel with each other;

the voltage input module is configured to receive a driving voltage; and the first switching part is configured to receive a switching quantity signal, wherein the switching quantity signal received by the first switching part is configured to control a turn-on or a turn-off of the first switching part, and when the first switching part is turned on, a turn-on voltage is output from the voltage input module to a gate, and wherein the method comprises steps of:

at a control terminal, determining the turn-on voltage to be output according to a requirement for the turn-on voltage;

at the control terminal, determining the switching quantity signal received by the first switching part according to the turn-on voltage to be output;

at the control terminal, outputting the switching quantity signal received by the first switching part;

at a driving terminal, receiving the switching quantity signal received by the first switching part; and at the driving terminal, outputting the turn-on voltage to the gate according to the switching quantity signal received by the first switching part.

10. The method according to claim 9, wherein the step of outputting the turn-on voltage to the gate according to the switching quantity signal received by the first switching part may further comprise a step of dividing voltage for adjusting a value of the turn-on voltage.

11. The method according to claim 9, wherein the switching quantity signal received by the first switching part is a high-level signal or a low-level signal.

12. The method according to claim 10, wherein the switching quantity signal received by the first switching part is a high-level signal or a low-level signal.

13. The method according to claim 9, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, a first turn-on voltage is output;

when one of the switching quantity signal received by the first switching part and the switching quantity signal received by the third switching part is at a low level and other one of the switching quantity signal received by the first switching part and the switching quantity signal received by the third switching part is at the high level, a second turn-on voltage is output; and when the switching quantity signal received by the first switching part and the switching quantity signal received by the third switching part both are at the low level, a third turn-on voltage is output, wherein the first turn-on voltage is larger than the second turn-on voltage, and the second turn-on voltage is larger than the third turn-on voltage.

14. The method according to claim 10, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, a first turn-on voltage is output;

when one of the switching quantity signal received by the first switching part and the switching quantity signal received by the third switching part is at a low level and other one of the switching quantity signal received by the first switching part and the switching quantity signal received by the third switching part is at the high level, a second turn-on voltage is output; and when the switching quantity signal received by the first switching part and the switching quantity signal received by the third switching part both are at the low level, a third turn-on voltage is output, wherein the first turn-on voltage is larger than the second turn-on voltage, and the second turn-on voltage is larger than the third turn-on voltage.

15. The method according to claim 11, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, a first turn-on voltage is output;

when one of the switching quantity signal received by the first switching part and the switching quantity signal received by the third switching part is at a low level and other one of the switching quantity signal received by the first switching part and the switching quantity signal received by the third switching part is at the high level, a second turn-on voltage is output; and when the switching quantity signal received by the first switching part and the switching quantity signal received by the third switching part both are at the low level, a third turn-on voltage is output, wherein the first turn-on voltage is larger than the second turn-on voltage, and the second turn-on voltage is larger than the third turn-on voltage.

16. The method according to claim 12, wherein the control module further comprises a third control unit connected in parallel with the first control unit, wherein the third control unit comprises a third switching part and a third voltage division part, wherein:

when the switching quantity signal received by the first switching part and a switching quantity signal received by the third switching part both are at a high level, a first turn-on voltage is output;

when one of the switching quantity signal received by the first switching part and the switching quantity signal received by the third switching part is at a low level and other one of the switching quantity signal received by the first switching part and the switching quantity signal received by the third switching part is at the high level, a second turn-on voltage is output; and when the switching quantity signal received by the first switching part and the switching quantity signal received by the third switching part both are at the low level, a third turn-on voltage is output, wherein the first turn-on voltage is larger than the second turn-on voltage, and the second turn-on voltage is larger than the third turn-on voltage.

17. A gate voltage driving circuit of a liquid crystal display device, wherein the gate voltage driving circuit comprises a first resistor, a second resistor, a third resistor, a fourth resistor, a fifth resistor, a first field effect transistor, a second field effect transistor, a voltage input terminal, and a voltage output terminal, wherein:

the first resistor and the first field effect transistor are connected in series with each other as a first subcircuit;

the second resistor and the second field effect transistor are connected in series with each other as a second subcircuit;

the third resistor, the fourth resistor, and the fifth resistor are connected in parallel with one another as a third subcircuit;

the first subcircuit, the second subcircuit, and the third subcircuit are connected in parallel with one another, and then are connected between the voltage input terminal and the voltage output terminal; and a gate of the first field effect transistor and a gate of the second field effect transistor are configured to receive a first switching quantity signal and a second switching quantity signal respectively, wherein:

the first switching quantity signal is configured to control a turn-on and a turn-off of the first field effect transistor, and when the first field effect transistor is turned on, a turn-on voltage is output from the voltage output module to the gate of the first field effect transistor, and the second switching quantity signal is configured to control a turn-on and a turn-off of the second field effect transistor, and when the second field effect transistor is turned on, the turn-on voltage is output from the voltage output module to the gate of the second field effect transistor.

* * * * *